US006248493B1

(12) United States Patent
Ogura et al.

(10) Patent No.: US 6,248,493 B1
(45) **Date of Patent: *Jun. 19, 2001**

(54) TONER FOR NON-MAGNETIC SINGLE COMPONENT DEVELOPMENT

(75) Inventors: Katsuyuki Ogura, Omiya; Masanobu Nakamura, Warabi; Hiroyuki Mariko, Tokyo; Yoshinori Shimane, Ichikawa; Ryozo Sugawara, Sodegaura; Hiroyuki Terada, Ichihara; kinji Shinzo, Sakura, all of (JP)

(73) Assignee: Dainippon Ink and Chemicals, Inc., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/401,782

(22) Filed: Sep. 22, 1999

(30) Foreign Application Priority Data

Sep. 25, 1998 (JP) ..... 10-271251

(51) Int. Cl.[7] ..... G03G 9/087
(52) U.S. Cl. ..... 430/110; 430/137
(58) Field of Search ..... 430/106, 110, 430/111, 137

(56) References Cited

U.S. PATENT DOCUMENTS 5,057,392 * 10/1991 McCabe et al. ..... 430/109
5,112,715 5/1992 DeMejo et al. .
5,147,747 9/1992 Wilson et al. .
5,486,444 1/1996 Bayley et al. .
5,780,195 7/1998 Nava .
5,908,727 * 6/1999 Kawaji et al. ..... 430/110

FOREIGN PATENT DOCUMENTS 0 617 337 A2 9/1994 (EP) .
0 716 351 A2 6/1996 (EP) .
2 237 399 1/1991 (GB) .
60-98444 6/1985 (JP) .
62-215962 9/1987 (JP) .
62-295068 * 12/1987 (JP) .
3-2300 1/1991 (JP) .
6-118706 4/1994 (JP) .
6-118711 4/1994 (JP) .
8-27554 3/1996 (JP) .
9-15907 1/1997 (JP) .
WO 97/49006 12/1997 (JP) .
11-15199 1/1999 (JP) .
WO 97/49006 12/1997 (WO) .

* cited by examiner

*Primary Examiner*—John Goodrow
(74) *Attorney, Agent, or Firm*—Armstrong, Westerman, Hattori, McLeland & Naughton, LLP

(57) ABSTRACT

Use of a polyester resin obtained by reacting a divalent or higher epoxy compound, a dibasic or higher polybasic acid compound selected from a polybasic acid and/or acid anhydride and/or lower alkyl ester thereof, and a divalent or higher polyvalent alcohol in a toner for electrostatic charge development containing at least a binder resin, a colorant, and a charge control agent can provide a toner for a non-magnetic single component development having excellent fixing properties, offset resistance and development durability.

11 Claims, 1 Drawing Sheet

TONER FOR NON-MAGNETIC SINGLE COMPONENT DEVELOPMENT

BACKGROUND OF THE INVENTION

1. Field of the Invention

The present invention relates to a toner for non-magnetic single component development for use in the development of electrophotography.

This application is based on Japanese Patent Application No. Hei 10-271251, the content of which is incorporated herein by reference.

2. Description of Related Art

Powder toners used in electrophotography are required to have suitable levels of electric properties such as triboelectrification and electric resistance that relate to development and transfer performance, thermal properties that relate to fixing performance and heat resistance performance (storage stability), and properties of powder such as flowability and hardness depending on the conditions of use.

Resin materials conventionally used for powder toners include polystyrenes, styrene/acrylic acid ester copolymers, styrene/butadiene copolymers, polyesters, epoxy resins, butyral resins, xylene resins, coumarone-indene resins, etc. and various proposals have been made on detailed designs of resins depending on their application.

In particular, for resins for use in heat roll fixing, improvements in the performance of fixing on transfer paper and offset resistance have been required. The fixing performance of a toner is achieved by heat melting it using a fixing roller or the like and fixing it on transfer paper and the offset performance of a toner means that the toner molten on a heating roller does not cause cold offset and causes no hot offset when it loses viscosity.

To achieve this object, many design examples have been proposed. In particular, to maintain viscoelasticity upon heat melting or prevent change in viscosity relative to temperature change, a technology has been studied which involves expansion of molecular weight distribution, imparting a crosslinking structure, application of a rubber elastic material, etc. For example, Japanese Patent Application First Publication No. Hei 1-267661 discloses a technology using these means.

For electrophotography, various methods are described in U.S. Pat. No. 2,297,691, Japanese Examined Published Application No. Sho 42-23910 and Japanese Examined Published Application No. Sho 43-24748. Generally, an electrostatic charge latent image is formed by various methods using a photoconductive substance and the latent image is developed with a developer (static charge developing toner) to obtain a visible image, which is fixed by pressurization, heating or with vapor of a solvent after it is transferred on paper, if desired, to thereby obtain a fixed image.

Many methods are known as developing methods in electrophotography. They are roughly divided into two-component developing methods using as a developer a mixture of a carrier consisting of fine particles of iron powder, ferrite, nickel, glass or the like (20–500 $\mu$m) and toner and single component developing methods using a developer consisting of a toner alone. In either method, generally charges are injected into the toner by triboelectrification.

Typical examples of the two-component developing method include a cascade method described in U.S. Pat. No. 2,618,552 and a magnetic brush method as described in U.S. Pat. No. 2,874,063. These method can give good images stably. However, they tend to suffer from contamination of the surface of the carrier with toner and deterioration of image quality due to a change in triboelectrification attributable to the fluctuation in the mixing ratio of the carrier and the toner and various efforts have to be made with regard to apparatus and materials used as countermeasures to prevent such.

The single component developing method, which is contemplated to obviate these problems associated with the two-component developing method, includes, for example, a method for developing using an electrically insulating magnetic toner as described in U.S. Pat. No. 4,336,318. In the method, triboelectrification between toner particles and the toner carrier or the toner thinning member, or triboelectrification between the toner particles themselves results in injecting charges into the toner so that the toner adheres to the static charge image on the photoconductor.

This developing method has the advantages that it can obviate the above-described problems of the two-component developing method and the developing apparatus can be down sized since it uses no carrier and a device which controls the mixing ratio of a carrier and a toner is no longer necessary.

On the other hand, the above method involves the formation of a magnetic brushed layer of toner on a metallic sleeve so that it is necessary for the toner to have appropriate magnetic properties, resulting in the toner containing a magnetic material such as magnetite and ferrite as an essential material in the components constituting the toner. The necessary content of the magnetic material may vary more or less depending on the conditions of development, the kind of materials, etc., but generally it can be said to be 30 to 60% by weight.

However, generally speaking, to contain a large amount of such a magnetic material as described above that has a low electric resistance and readily absorbs moisture causes a decrease in electric resistance and a decrease in moisture resistance of the toner itself and as a result it is difficult to obtain stable developing performance against the change in environment to cause a considerable fluctuation in image density or background contamination level in various environments of use.

If the proportion of the resin material contained in the toner as a binder is smaller than that in the two-component toner, it may be disadvantageous in design from the viewpoint of fixing performance. Further, in view of the use of color images which are increasingly being used recently, there are problems such that most of the magnetic material must be colored so that the colors available are limited or it is difficult to obtain sharp color image quality.

To solve the above problems of the single component developing method using a magnetic toner, there has been proposed a non-magnetic single component developing method in which the toner does not have to have magnetic properties. To achieve such a method, various apparatuses have been studied, in most of which a toner is adhered on a developing sleeve and transported to a latent image surface by virtue of electrostatic power to effect development, thus markedly differing from the conventional magnetic single component developing method in that no magnetic material is necessary as an essential component in the composition of the toner, so that it is expected that the above-described various problems originating from the contained magnetic material can be obviated.

In the non-magnetic single component developing method, use is made of a powder toner for electrophotography that contains a binder resin, a colorant, and a charge control agent as essential components.

As the binder resin, a polyester resin is used since it is necessary to secure stability in electrification and durability in continuous printing.

However, demands in the market for excellent low temperature fixing properties and offset resistance as well as durability in continuous printing have been growing higher but it has been difficult to obtain a non-magnetic single component toner which meets these properties sufficiently.

BRIEF SUMMARY OF THE INVENTION

An object of the present invention is to provide a non-magnetic single component toner that has excellent fixing properties and offset resistance as well as excellent durability in that it electrifies stably to give satisfactory images upon continuous printing.

The present inventors have made intensive studies in order to solve the above problems and as a result they have accomplished the present invention.

More specifically, to solve the above problems, the present invention provides a toner for non-magnetic single component development comprising at least a binder resin, a colorant, and a charge control agent, wherein the binder resin comprises a polyester resin obtained by reacting a divalent or higher epoxy compound, a dibasic or higher polybasic acid compound selected from a polybasic acid and/or acid anhydride and/or lower alkyl ester thereof, and a divalent or higher polydivalent alcohol.

In the present invention, a toner for non-magnetic single component development comprises at least a binder resin, a colorant, and a charge control agent, wherein the binder rein is a polyester resin obtained by reacting (1) a divalent or higher epoxy compound, (2) a divalent or higher polybasic acid compound selected from a polybasic acid and/or acid anhydride and/or lower alkyl ester thereof, and (3) a divalent or higher polydivalent alcohol.

In the present invention, a polyester resin crosslinked with a divalent or higher epoxy compound as the binder resin is used, resulting in that a toner for non-magnetic single component development that is excellent in fixing properties, offset resistance and development durability can be provided.

DETAILED DESCRIPTION OF THE INVENTION

Figure 1:
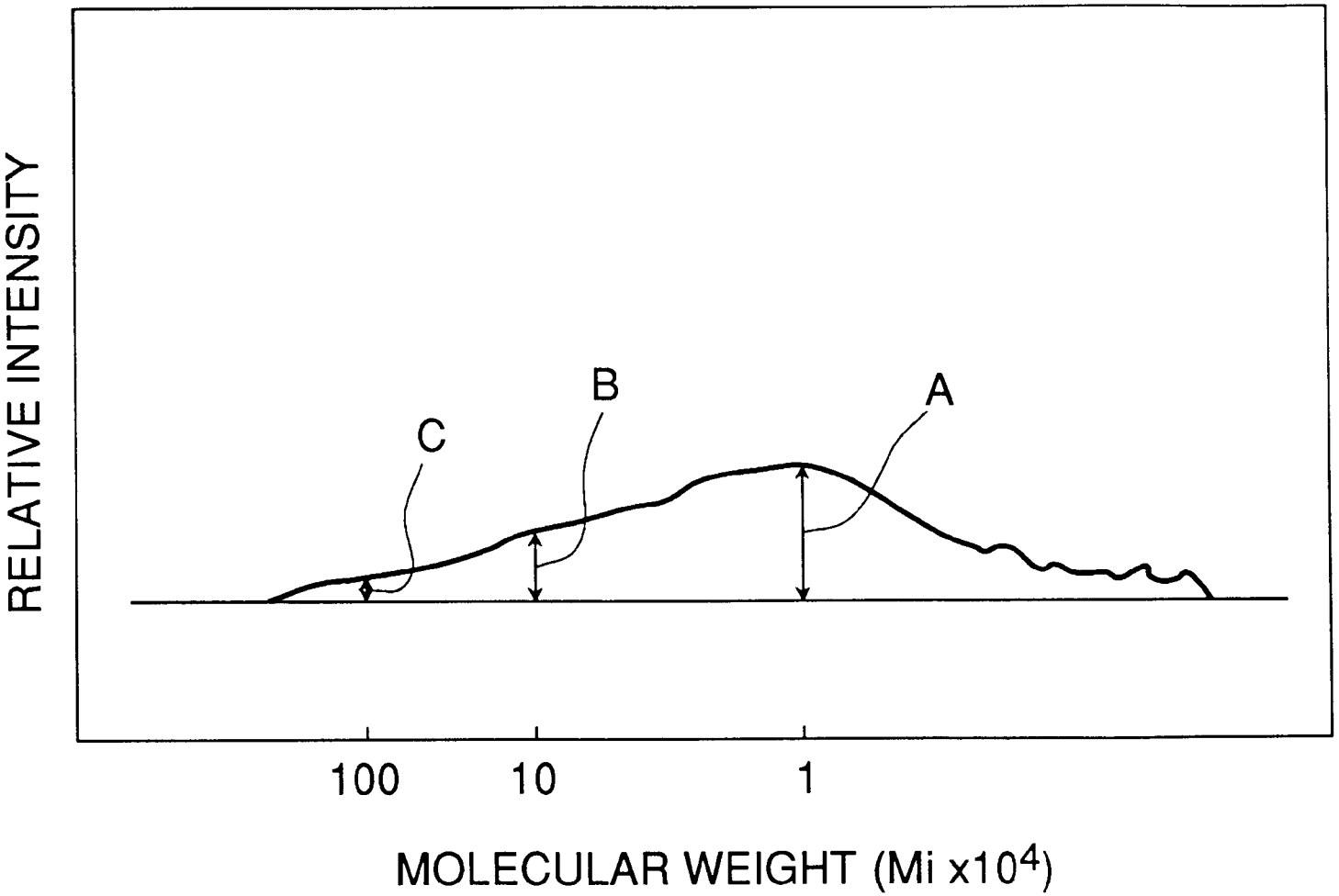
FIG. 1 is a diagrammatic graph showing GPC data measured with regard to a binder resin used in the present invention.

The divalent or higher epoxy compound (1) used in the present invention includes, for example, cresol novolak type epoxy resins, phenol novolak type epoxy resins, polymers or copolymers of a vinyl compound having an epoxy group, epoxylated resorcinol-acetone condensate, partially epoxidized polybutadiene, etc.

Other epoxy compounds having two or more epoxy groups used in the present invention include, for example, bisphenol A type epoxy compound, bisphenol F type epoxy resin, bisphenol S type epoxy resin, ethylene glycol diglycidyl ether, hydroquinone diglycidyl ether, N,N-diglycidyl aniline, glycerin triglycidyl ether, trimethylolpropane triglycidyl ether, trimethylolethane triglycidyl ether, pentaerythritol tetraglycidyl ether, 1,1,2,2-tetrakis(p-hydroxyphenyl)-ethane tetraglycidyl ether, semi-dry or dry fatty acid ester epoxy compound, etc.

Among these, more suitably used are bisphenol A type epoxy resin, bisphenol F type epoxy resin, bisphenol S type epoxy resin, cresol novolak type epoxy resin, phenol novolak type epoxy resin, glycerin triglycidyl ether, trimethylolpropane triglycidyl ether, trimethylethane triglycidyl ether, and pentaerythritol tetraglycidyl ether.

More specifically, examples of the bisphenol A type epoxy resin include Epiclon 850, Epiclon 1050, Epiclon 2055, Epiclon 3050, etc. manufactured by Dainippon Ink and Chemicals, Inc. and examples of the bisphenol F type epoxy resin include Epiclon 830 and Epiclon 520 manufactured by Dainippon Ink and Chemicals, Inc.

More specifically, examples of the orthocresol novolak type epoxy resin include Epiclon N-660, N-665, N-667, N-670, N-673, N-680, N-690, N-695, etc. The polymer or copolymer of vinyl compound having an epoxy group includes a homopolymer of glycidyl (meth)acrylate, or a copolymer with alkyl acrylate or a copolymer with styrene. Among these, cresol novolak type epoxy resins and phenol novolak type epoxy resins are used more suitably.

Further, pentavalent or higher epoxy resins, in particular cresol novolak type epoxy resins and phenol novolak type resins, are used particularly suitably.

The epoxy compounds described above may be used as combinations of two or more of them or in combination with the following monoepoxy compounds. The monoepoxy compounds which can be used simultaneously include, for example, phenyl glycidyl ether, alkyl phenyl glycidyl ethers, alkyl glycidyl ethers, alkyl glycidyl esters, glycidyl ethers of alkyl phenol alkylene oxide adducts, α-olefin oxides and monoepoxy fatty acid alkyl esters, etc.

Use of these monoepoxy compounds in combination improves fixing properties and offset resistance at high temperatures. Among them, alkyl glycidyl esters are used more suitably.

The divalent or higher polybasic acid compound (2) selected from a polybasic acid and/or acid anhydride and/or lower alkyl ester thereof includes, for example, dicarboxylic acids such as phthalic anhydride, terephthalic acid, isophthalic acid, orthophthalic acid, adipic acid, maleic acid, maleic anhydride, fumaric acid, itaconic acid, citraconic acid, hexahydrophthalic anhydride, tetrahydrophthalic anhydride, cyclohexanedicarboxylic acid, succinic acid, malonic acid, glutaric acid, azelaic acid, and sebacic acid, or derivatives or esterified products thereof, and tribasic or higher polybasic carboxylic acids, for example, trimellitic acid, trimellitic anhydride, pyromellitic acid, pyromellitic anhydride, etc. or derivatives or esterified products thereof.

In the present invention, it is preferred that the divalent or higher polybasic acid compound (2) selected from a polybasic acid and/or acid anhydride and/or lower alkyl ester thereof used be only dibasic ones.

These polybasic acid compounds (2), as described above, include polybasic acid compounds having addition polymerizability such as maleic acid and fumaric acid and non-addition polymerizable polybasic acid compounds such as terephthalic acid and adipic acid. In the present invention, it is preferable to use a non-addition polymerizable polybasic acid compound alone as the polybasic acid compound (2).

The divalent or higher polyvalent alcohol (3) which can be used in the present invention includes aromatic polyvalent alcohols and aliphatic polyvalent alcohols.

The divalent or higher polyvalent alcohol (3) includes, for example, ethylene glycol, diethylene glycol, propylene glycol, dipropylene glycol, tripropylene glycol, butanediol, pentanediol, hexanediol, bisphenol A, polyoxyethylene-(2.0)-2,2-bis(4-hydroxyphenyl)propane and derivatives thereof, polyoxypropylene-(2.0)-2,2-bis(4-hydroxyphenyl) propane, polyoxypropylene-(2.2)-polyoxyethylene-(2.0)-2,2-bis(4-hydroxyphenyl)propane, polyoxypropylene-(6)-2,2-bis(4-hydroxyphenyl)propane, polyoxypropylene-(2.2)-2,2-bis(4-hydroxyphenyl)propane, polyoxypropylene-(2.4)-2,2-bis(4-hydroxyphenyl)propane, polyoxypropylene-(3.3)-2,2-bis(4-hydroxyphenyl)propane, and derivatives thereof, diols such as polyethylene glycol, polypropylene glycol, ethylene oxide-propylene oxide random copolymer diol, ethylene oxide-propylene oxide block copolymer diol, ethylene oxide-tetrahydrofuran copolymer diol, and polycaprolactone diol, trivalent or higher polyvalent alcohols such as sorbitol, 1,2,3,6-hexanetetraol, 1,4-sorbitan, pentaerythritol, 1,2,4-butanetriol, 1,2,5-pentanetriol, glycerin, 2-methylpropanetriol, 2-methyl-1,2,4-butanetriol, trimethylolethane, trimethylolpropane, and 1,3,5-trimethylolbenzene.

In the present invention, bisphenol A propylene oxide adducts, for example, polyoxypropylene-(6)-2,2-bis(4-hydroxyphenyl)propane, polyoxypropylene-(2.2)-2,2-bis(4-hydroxyphenyl)propane, polyoxypropylene-(2.4)-2,2-bis(4-hydroxyphenyl)propane, polyoxypropylene-(3.3)-2,2-bis(4-hydroxyphenyl)propane, and derivatives thereof are called polyoxypropylene-bis(4-hydroxyphenyl)propane.

In the present invention, bisphenol A ethylene oxide adducts, for example, polyoxyethylene-(2.0)-2,2-bis(4-hydroxyphenyl)propane, polyoxyethylene-(2.2)-polyoxyethylene-(2.0)-2,2-bis(4-hydroxyphenyl)propane, polyoxyethylene-(6)-2,2-bis(4-hydroxyphenyl)propane, polyoxyethylene-(2.2)-2,2-bis(4-hydroxyphenyl)propane, polyoxyethylene-(2.4)-2,2-bis(4-hydroxyphenyl)propane, polyoxyethylene-(3.3)-2,2-bis(4-hydroxyphenyl)propane, and derivatives thereof are called polyoxyethylene-bis(4-hydroxyphenyl)propane.

The aliphatic polyvalent alcohol includes, in addition to the above described ones, 1,4-cyclohexanedimethanol, triethylene glycol, etc. as aliphatic diols.

It is preferable to use only divalent ones as the divalent or higher polyvalent alcohol.

The present invention includes two embodiments in which divalent or higher polyvalent alcohols are used as follows.

1) Embodiment where an Aromatic Polyvalent Alcohol is used as a Major Component

By selecting as a binder resin a polyester resin comprising as an essential component a divalent or higher polyvalent alcohol, for example, a bisphenol A polyoxyalkylene oxide adduct such as polyoxyethylene-bis(4-hydroxyphenyl) propane or polyoxypropylene-bis(4-hydroxyphenyl) propane, the mechanical strength of the toner can be increased. As a result, a toner can be obtained that can endure mechanical shearing such as stirring or the like in a developing apparatus during a long period printing, and that can form a tougher and stronger toner film after fixing that is resistant to friction or bending.

If comparison is to be made between the polyester resin obtained using polyoxyethylene-bis(4-hydroxyphenyl) propane as a major component with the polyester resin obtained from polyoxypropylene-bis(4-hydroxyphenyl) propane as a major component, the toner obtained by using the latter has just a little greater particle strength and hence is superior in durability, resistance to friction and bending properties over the toner obtained by using the former.

In this embodiment, when an aliphatic diol is used in combination, it is desirable that the proportion of the aliphatic diol based on the total alcohol component is 30% by mole or less. More preferably, it is 20% by mole or less.

(2) Embodiment where an Aliphatic Polyvalent Alcohol is used as a Major Component Use of an aliphatic polyvalent alcohol results in good compatibility of the polyester resin with waxes so that offset resistance can be improved. Softening of the polyester main chain improves fixing properties at low temperatures.

In this case, it is preferable that the combination of a polyvalent carboxylic acid and a polyvalent alcohol used together with the epoxy compound having two or more epoxy groups be an aromatic dicarboxylic acid and an aliphatic diol having an ether bond in the main chain thereof.

Preferred aromatic dicarboxylic acid includes, for example, phthalic anhydride, terephthalic acid, isophthalic acid, orthophthalic acid, etc. The preferred aliphatic diol having an ether bond in the main chain thereof includes, for example, diols such as diethylene glycol, triethylene glycol, dipropylene glycol, tripropylene glycol, polyethylene glycol, polypropylene glycol, ethylene oxide-propylene oxide random copolymer diol, ethylene oxide-propylene oxide block copolymer diol, ethylene oxide-tetrahydrofuran copolymer diol, and polycaprolactonediol.

The amount of aromatic dicarboxylic acid used is desirably 60% by mole or more, more desirably 70% by mole or more, based on the total acid components. It is desirable that the amount of aliphatic diol having an ether bond in the main chain thereof used be 5 to 50% by mole, preferably 10 to 40% by mole. By selecting these combinations and use amounts, fixing properties at low temperatures are increased and dispersibility of waxes is good so that the offset resistance can be improved.

In this case, when the aromatic diol is used in combination, it is desirable that the proportion of the aromatic diol be 30% by mole or less based on the total alcohol components. More preferably, it is 20% by mole or less.

The polyester resin used in the present invention can be obtained by a dehydrocondensation reaction or ester exchange reaction of starting material components (1), (2), and (3) in the presence of a catalyst. In this situation, the reaction temperature and reaction time are not limited particularly but usually the reaction proceeds at 150 to 300° C. for 2 to 24 hours.

As the catalyst used in the above reaction, for example, zinc oxide, tin oxide, dibutyl tin oxide, dibutyl tin dilaurate, p-toluenesulfonic acid, etc. may be used suitably. Tetrabutyl titanate may also be used.

The polyester resin in the present invention can be produced by a process of the following types 1 to 3.

<Type 1>: Components (1), (2), and (3) are charged in a lump reacted (en bloc reaction);

<Type 2>: After (1) and (2) are reacted, (3) is reacted, or after (1) and (3) are reacted, (2) is reacted (two-step reaction); and <Type 3>: After production of a polyester main chain by reaction of (2) and (3), (1) is reacted (two-step reaction)

However, the skeletons of the resins produced by the three types of reactions differ slightly from each other. In Types 1 and 2, the epoxy compound as the crosslinking agent reacts with a carboxylic acid monomer and/or an alcohol monomer before a main chain extension reaction can take place. Therefore, in this case, before the reaction of main chain extension takes place, one molecule of a carboxylic acid or alcohol monomer and the number of molecules corresponding to the valence of the monomer, that is, 2 or more molecules of epoxy crosslinking agent are reacted. In an extreme case, such a reaction takes place in a chain connection so that there occurs a portion where the epoxy crosslinking agent is present in a very high density.

In particular, in the case of the epoxy compound as used in the present invention, one epoxy group reacts with a carboxyl group or a hydroxyl group to generate a secondary hydroxyl group, which reacts with another carboxyl group. That is, one epoxy group acts as a divalent group so that the divalent or higher epoxy compound used in the present invention acts at least as a tetravalent crosslinking agent. As a result, the polyester resins in the reactions of Type 1 and Type 2 assume a crosslinked structure at a very high density.

As stated above, in the present invention, an epoxy compound having two epoxy groups in the molecule is called a divalent epoxy compound and similarly an epoxy compound having five epoxy groups is called a pentavalent epoxy compound.

On the other hand, the generation of a dense portion by the concentration of the crosslinking agent conversely means generation of a portion low in density in a subsequent main chain extension reaction. In other words, in Type 1 and Type 2, a high crosslinked portion and a low crosslinked portion occur in the resin to generate a fluctuation in the density of crosslinking.

In addition, toner is fixed in such a manner that the lower molecular component in the binder resin is molten and penetrates into the paper or fuses with adjacent toner particles. Further, the high molecular component in the binder resin retains elasticity even at high temperatures to prevent offset to the fixing roll. Therefore, having non-uniformity in density of crosslinking in the binder resin means that it has a very wide molecular weight distribution, which gives rise to good fixing properties and offset resistance in a wider temperature region. The toner that retains a high crosslinking density portion has enough mechanical strength to endure stress in a developing apparatus and friction with a developing sleeve.

On the other hand, the Type 3 reaction is a method in which first a carboxylic acid and an alcohol are reacted to form a main chain and then an epoxy crosslinking agent is reacted. In this case, epoxy compounds react with both ends of the polyester main chain so that the probability that a structure in which the epoxy crosslinking agent molecules are close to each other as observed in Type 1 and Type 2 reactions is generated is very low.

In the present invention, the divalent or higher epoxy compound is essential and this method gives a considerable crosslinking density and a wide molecular weight distribution but less than what is achieved by Type 1 and Type 2 reactions.

For the above reasons, it is more preferred that Type 1 and Type 2 reactions be used for the production of the polyester resin of the present invention. Further, it is most preferred that a Type 1 reaction be used from the viewpoint of shortening and simplification of the production step.

The polyester resin in the present invention may be a crosslinked polyester containing crosslinking by an epoxy compound and crosslinking by an unsaturated double bond, obtained by using an unsaturated dibasic acid as a portion or whole of the above component (2). In this case, usually a method is used in which a precursor polyester resin containing an intramolecular double bond is produced so that the unsaturated double bond in the unsaturated dibasic acid will not be cleaved and then the intramolecular double bonds in the precursor resin are cleaved so that polymerization and crosslinking can occur.

The unsaturated dibasic acid includes maleic acid, maleic anhydride, fumaric acid, itaconic acid, mesaconic acid, citraconic acid, etc.

The polyester resin used in the present invention is sufficient if it has a suitable glass transition temperature and melt viscosity properties as a toner for non-magnetic single component development and one having a viscosity of $1\times10^5$ poises at a temperature of 90° C. or greater is preferred because of good fixing properties. Among the polyester resins, one having a viscosity of $1\times10^5$ poises at a temperature of 90 to 180° C. or greater is preferred.

As the binder resin used in the present invention, one having a Tg of 55 to 85° C. and a softening point of 90 to 180° C. is particularly preferred. Here, the Tg is measured in accordance with a DSC measurement method, and the softening point is measured in accordance with ASTM E28-517.

In the case where the softening point is below 90° C., the toner tends to cause the phenomenon of agglomeration, causing troubles upon storage, poor fixing properties at temperatures above 180° C. during printing. On the other hand, one having a glass transition temperature (Tg) of 55° C. or more is preferred, in particular one having a Tg of 55 to 85° C. is particularly preferred.

It is preferred that the polyester resin has an acid value of 20 KOHmg/g or less since the toner has good moisture resistance.

Preferably, the polyester resin in the present invention is a resin that has a ratio (Mw/Mn) of the weight average molecular weight (Mw) to number average molecular weight (Mn) as measured by gel permeation chromatography (hereafter, GPC) of 10 or more, and/or a ratio ($I_{10}/I_{01}$) of the relative intensity ($I_{10}$) at a position corresponding to the molecular weight of polystyrene of 100,000 to the relative intensity ($I_{01}$) at a position corresponding to the molecular weight of polystyrene of 10,000 as measured by GPC of 0.1 to 0.7. Among them, the resin having a ratio (Mw/Mn) of 15 to 60 and the resin having a ratio (Mw/Mn) of 10 or more, preferably 15 to 60, and a ratio ($I_{10}/I_{01}$) of 0.1 to 0.7 are most preferred. The molecular weight of resin in the present invention is a value obtained by measurement by GPC of a component that is dissolved in tetrahydrofuran.

If Mw/Mn is below 10 or ($I_{10}/I_{01}$) is below 0.1, the offset resistance is degraded at high temperatures and if ($I_{10}/I_{01}$) is above 0.7, the fixing properties at low temperatures are degraded.

In a further preferred embodiment, it is preferred from the viewpoint of the balance between fixing properties at low temperatures and offset resistance that the polyester resin has a ratio (Mw/Mn) of weight average molecular weight (Mw) to number average molecular weight (Mn) as measured by GPC of 10 or more, and/or a ratio ($I_{10}/I_{01}$) of the relative intensity ($I_{10}$) at a position corresponding to the molecular weight of polystyrene of 100,000 to the relative intensity ($I_{01}$) at a position corresponding to the molecular weight of polystyrene of 10,000 as measured by GPC of 0.1 to 0.7, and further a ratio ($I_{100}/I_{01}$) of the relative intensity ($I_{100}$) at a position corresponding to the molecular weight of polystyrene of 1,000,000 to the relative intensity ($I_{01}$) at a position corresponding to the molecular weight of polystyrene of 10,000 as measured by GPC of 0.01 to 0.3.

The respective molecular weights of the polyester resins in the present invention are molecular weights in terms of polystyrene.

In the present invention, the values of weight average molecular weight (Mw), number average molecular weight (Mn), and relative intensities ($I_{100}$, $I_{10}$, $I_{01}$) at positions corresponding to the molecular weights of polystyrene were measured under the following measuring conditions.

| | |
|---|---|
| GPC apparatus: manufactured by Tosoh Corp. | HLC-8120 GPC |
| COLUMN: manufactured by Tosoh Corp. | TDK-GEL G-5000HXL |
| | G-4000HXL |
| | G-3000HXL |
| | G-2000HXL |

-continued

| |
|---|
| Solvent: Tetrahydrofuran |
| Solvent concentration 1.0 ml/min |

(Resin containing a tetrahydrofuran insoluble gel portion was filtered using a membrane filter or the like before the measurement of molecular weight.)

The colorant used in the present invention may be various organic pigments and inorganic pigments that are non-magnetic. Specific examples thereof include carbon black, aniline blue, chalcoyl blue, Chrome Yellow, ultramarine blue, DuPont oleyl red, quinoline yellow, methylene blue chloride, Phthalocyanine Blue, malachite green oxalate, lamp black, rose red iron, disazo yellow, quinacridone red, watching red, Pigment Red 122, C. I. Pigment Yellow 97, C. I. Pigment Blue 15, C. I. Pigment Yellow 180, etc. They are used singly or two or more of them may be used in combination.

Other colorants include red colorants such as azo based C. I. Pigment Red 22, C. I. Pigment Red 48:1, C. I. Pigment Red 48:3, and C. I. Pigment Red 57:1, yellow colorants such as azo-based ones, e.g., C. I. Pigment Yellow 155, benzimidazolone-based C. I. Pigment Yellow 151 and C. I. Pigment Yellow 154.

The carbon black includes, for example, Mogul L, ELF-TEX 8 (both manufactured by Cabbott Corp.), MA 100 (produced by Mitsubishi Chemical Co., Ltd.), etc.

In the toner of the present invention, the proportion by weight of the binder resin to the colorant is not limited particularly but is usually 1 to 60 parts by weight, and preferably 3 to 30 parts by weight, of a colorant per 100 parts by weight of a binder resin.

In the present invention, either of a positive charge control agent and a negative charge control agent may be used.

The static control agent used in the present invention includes known conventional charge control agents such as heavy metal-containing acid dyestuff, for example, Nigrosine dyestuff, quaternary ammonium salts, trimethylethane dyestuff, copper phthalocyanine, perylene, quinacridone, azo pigments, metal complex salt azo dyestuff, and azo chromium complex salt. To achieve the object of the present invention in a negatively chargeable toner for non-magnetic single component development, it is preferred that the following two kinds of charge control agents be used in combination.

Chemical Formula 1

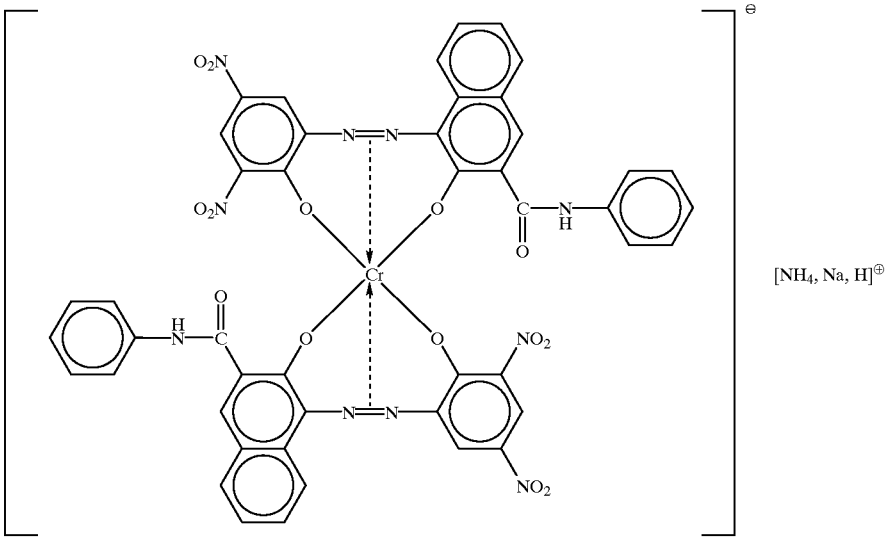

In chemical formula 1 above, $[NH_4, Na, H]$ indicates either one of $NH_4$, Na or H.

Chemical Formula 2

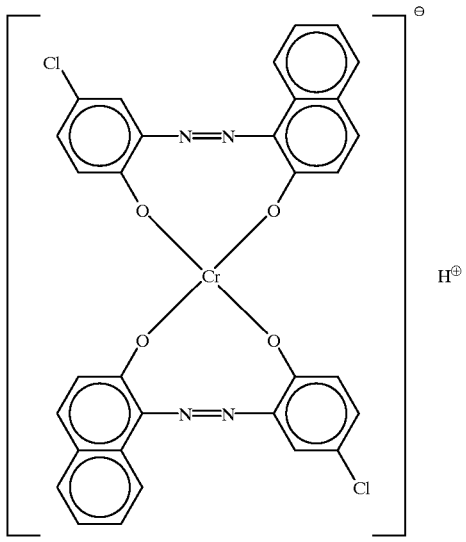

The proportion by weight of each charge control agent is not limited particularly but preferably the two types of charge control agents represented by the chemical formulae 1 and 2 above are used in a proportion of 40/60 to 60/40 (by weight) taking the total weight of them as 100.

Further, it is desirable that they be used in a total amount of 0.5 to 3 parts by weight per 100 parts by weight of the solids content of the binder resin (A).

As the charge control agent used in the present invention, negative charge control agents other than the one described above may be used, for example, metal complex salts of salicylic acid, metal complex salts of benzylic acid, phenol condensates of calix arene type, cyclic polysaccharides, resins containing a carboxyl group and/or a sulfonyl group, etc.

To obtain the toner of the present invention, various aids such as a charge control agent, a releasing agent, and a flowability improver may be added. It is effective that the flowability improver be adhered on the surface of toner particles.

Further, in heat roll fixation applications, various waxes may be used as needed as an aid for increasing the releasing effect in order to prevent troubles due to heat roll adhesion contamination (offset) of a toner. For example, natural waxes such as montanic acid ester wax, polyolefin waxes such as high-pressure polyethylene and polypropylene, silicone waxes, fluorine-contained waxes, etc.

Other waxes, for example, polyamide waxes, Fisher-Tropsh waxes, synthetic ester waxes such as Eructol WEP-5 (manufactured by Nippon Oils and Fats Co., Ltd.) can be used suitably.

Preferred waxes include, for example, Viscol 660P, Viscol 550P, Viscol 330P, TP-32 (manufactured by Sanyo Kasei Kogyo Co., Ltd.), Mitsui High Wax NP505, P200, P300, and P400, etc.

Other preferred waxes than the above include, for example, carnauba wax, montan ester wax, rice wax and/or scale insect wax.

These preferred waxes show the most preferred dispersibility for polyester resin having the specified structure of the present invention and improvement of fixing properties and offset resistance therewith is remarkable.

As for carnauba wax, it is preferable to use free fatty acid-removed-type carnauba wax from which free fatty acids have been removed by purification. The acid value of the free fatty acid-removed-type carnauba wax is preferably 8 or less, more preferably 5 or less. The free fatty acid-removed-type carnauba wax can give finer crystallite than conventional carnauba wax to improve dispersibility in polyester resins. The montan ester wax is one that is purified from a mineral and is converted into crystallites during the purification as in the case of carnauba wax to increase the dispersibility in polyester resins. In the case of montan ester wax, it is particularly preferred that the acid value be 30 or less. The rice wax is one that is purified from rice bran wax and is preferred to have an acid value of 13 or less. The scale insect wax can be obtained from a waxy component secreted by a larva of scale insect (another name: Chinese wax insect) by dissolving it in hot water, removing an upper layer and solidifying it by cooling or repeating the procedures. The scale insect wax purified by such means is white in a solid state and shows a very sharp melting point so that it is suitable for use as a wax for toner in the present invention. By purification, its acid value is lowered to 10 or less. For toners, the acid value is preferably 5 or less.

Furthermore, conventionally known resins, for example, vinyl resins such as styrene resins, styrene/(meth)acrylic acid ester copolymer resins and styrene/butadiene copolymer resins, epoxy resins, polyester resins, silicone resins, polyurethane resins, butyral resins, xylene resins, etc. may be blended in the polyester resins of the present invention in suitable amounts so long as the effects of the present invention are not lost. The blending amount is usually on the order of 1 to 30% by weight.

Among these, in particular, linear polyester resins synthesized from a dicarboxylic acid and a diol are desirable since mixing such with the crosslinked polyester resin of the present invention can give rise to a stable fixed image under lower temperature fixing conditions.

A preferred composition of the linear polyester resin which can be mixed with the polyester resin of the present invention includes, for example, condensates of phthalic anhydride, terephthalic acid, isophthalic acid, orthophthalic acid or derivatives or ester compounds thereof, with polyoxypropylene-bis(4-hydroxyphenyl)propane and/or polyoxyethylene-bis(4-hydroxyphenyl)propane. Such a polyester preferably has a Tg of 45 to 70° C. and a softening point of 80 to 100° C. and it is desirable that the blending ratio of the polyester resin of the present invention to the linear polyester be in the range of 95/5 to 70/30.

Also, a lubricant, for example, a metal soap, zinc stearate or the like and an abrasive, for example, cerium oxide, silicon carbide or the like can be used.

The toner of the present invention can be obtained by any conventionally known production method. For example, it can be obtained by melt kneading the binder resin, colorant and charge control agent at a temperature not lower than the melting point (softening point) of the binder resin and then pulverizing and grading. Of course, it may be produced by a method other than this method.

More specifically, the binder resin, colorant and charge control agent as essential components are mixed by kneading means such as a two-roll mill, a three-roll mill, a press kneader or a twin-screw extruder. In this case, the conditions of melt kneading are not limited particularly so long as the colorant is dispersed uniformly in the binder resin but usually mixing is conducted at 80 to 180° C. for 10 minutes to 2 hours.

To achieve uniform dispersion in the resin, the colorant may be subjected to a flushing treatment in advance, or alternatively a master batch may be obtained by melt kneading the colorant with the resin at high concentrations.

In the case where a releasing agent is added, the binder resin, colorant and releasing agent may be adjusted in advance so that the mixture is made of, for example, 1 to 10% by weight of the colorant, 0.5 to 5% by weight of the releasing agent, the balance the binder resin and charge control agent.

Then, the preliminary mixture is cooled and finely divided in a pulverizer such as a jet mill and graded by an air grading apparatus or the like. The toner particle preferably has an average particle diameter of 1 to 15 $\mu$m.

To the toner particles of the present invention, fine particles having a smaller particle diameter than the toner particles (hereafter, such particles being called as externally added agent) may be adhered. The externally added agent is not limited particularly on its material and kind so long as it can be effectively used for the surface improvement of the toner matrix such as to improve the flowability and electrification properties of the toner. There can be used, for example, inorganic fine powder such as power of silicon dioxide, titanium oxide, aluminum oxide, zinc oxide, tin oxide, or zirconium oxide, and surface treated products thereof obtained by treating them with a hydrophobic treating agent such as silicone oil or silane coupling agent, and fine powder of a resin such as polystyrene, acrylic resin, styrene/acrylic resin, polyester, polyolefin, cellulose, polyurethane, benzoguanamine, melamine, nylon, silicone, polyphenol, polyvinylidene fluoride or the like.

The toner powder of the present invention can be used as it is. However, external addition of silica is practical and suitable since it can increase the flowability of powder.

The silica used in the present invention includes those silicon dioxide preparations having hydrophobic properties, for example, those obtained by surface treating silicon dioxide particles with various polyorganosiloxanes, silane coupling agents, etc. For example, those commercially available under the following trade names can be used.

AEROSIL R972, R974, R202, R805, R812, RX200, RY200, R809, RX50 (Nippon Aerosil Co., Ltd.)

WACKER HDK H2000, H2050EP (Wacker Chemicals East Asia Co., Ltd.)

Nipsil SS-10, SS015, SS-20, SS-50, SS-60, SS-100, SS-50B, SS-50F, SS-10F, SS-40, SS-70, SS-72F (Nippon Silica Industry Co., Ltd.).

Other silica preparations include, for example, the following.

AEROSIL RA200HS, RA20H (Nippon Aerosil Co., Ltd.)

WACKER HDK H3050EP, HVK2150 (Wacker Chemicals East Asia Co., Ltd.)

CARBOSIL TG820F (Cabbott Specialty Chemicals, Inc.).

Silica includes one having a relatively large average particle diameter and one having a relatively small average particle diameter. These may be used singly or in combination. It is preferred that one having a larger particle size and one having a smaller particle size be used in combination since the flowability of toner is excellent, the adhesion of toner to the blade of a developing machine can be prevented, fogging is inhibited, durability against development is excellent, long term stability of electrification upon running can be obtained. The amount of externally added silica of 0.1 to 5.0 parts by weight per 100 parts by weight of toner is practical and suitable since the amount of charge is sufficient and there is no fear that the photoconductor drum will be damaged or that aggravation of the environment properties of the toner will be caused or for some other reasons.

The silica described above can be externally added to the toner particles, for example, by a method using a Henschel mixer, which is a usual mixing machine for powders, or a surface improving machine such as a hybridizer, etc. The external addition may be conducted by adhering silica to the surface of toner particles or by embedding a portion of the silica in the toner particle.

The combined use of large and small particle sizes, the amount of external addition and the method of external addition are the same for the above described externally added agent.

The non-magnetic single component developing method used in the present invention includes a non-magnetic single component developing method including triboelectrifying the toner for non-magnetic single component development of the present invention transported by a toner carrier with a layer thickness controlling member and at the same time controlling the thickness of the layer to make a thin layer of toner on the toner carrier so that the toner can face a carrier for a static charge latent image in contact or not in contact with it to effect development of the static charge latent image.

A single component developing method using a non-magnetic toner includes a contact type nonmagnetic single component developing method in which a developing sleeve carrying a developer makes contact with a photoconductor drum having a static charge latent image to effect development.

The toner obtained in the present invention can be used particularly effectively in a contact type non-magnetic single component developing method in which a toner is passed between a developing sleeve and an electrifying member pressed thereon to triboelectrify the toner and develop a static charge latent image formed on the surface of a photoconductor.

The thus-obtained toner for non-magnetic single component development is fixed on a recording medium by a conventionally known method. It is preferable to adopt a heat roll fixing method as the fixing method.

As the heat roll, there can be used one obtained by covering the surface of a cylinder that can be heated to a temperature that allows melt fixing the toner with a coating resin that has sufficient releasability and sufficient heat resistance, such as a silicone resin or a fluororesin.

In the heat roll fixing method, fixation of toner is achieved by passing a medium to be printed between two rolls pressed at a suitable pressure including at least one such heat roll as described above.

As the medium to be recorded in the present invention, any conventionally known one may be used, including, for example, papers such as paper, resin-coated paper, etc., synthetic resin films or sheets such as PET film, OHP sheet, etc.

The reason why the toner of the present invention exhibits remarkable effects is not fully clear but it is presumed that the toner of the invention is obtained by polymerizing a divalent or higher epoxy compound, a dibasic or higher polybasic acid compound selected from a polybasic acid and/or acid anhydride thereof and/or lower alkyl ester thereof, and a dihydric or higher polyhydric alcohol in a lump so that a polyester resin whose crosslinking density can be increased and which has a suitable molecular weight distribution can be can be obtained.

Modes for Carrying out the Invention

1. A toner for non-magnetic single component development, comprising at least a binder resin, a colorant, and a charge control agent, wherein the binder resin comprises a polyester resin obtained by reacting a divalent or higher epoxy compound, a dibasic or higher polybasic acid compound selected from a polybasic acid and/or acid anhydride and/or lower alkyl ester thereof, and a divalent or higher polyvalent alcohol.

2. The toner for non-magnetic single component development as described in 1 above, wherein the polybasic acid compound is a non-addition polymerizable polybasic acid compound.

3. The toner for non-magnetic single component development as described in 1 above, wherein the polyester resin has a glass transition temperature of 55 to 85° C. and a softening point of 90 to 180° C.

4. The toner for non-magnetic single component development as described in 1 above, wherein the charge control agent is a negative charge control agent.

5. The toner for non-magnetic single component development as described in 1 above, wherein the divalent or higher polyvalent alcohol comprises polyoxypropylene-bis(4-hydroxyphenyl)propane.

6. The toner for non-magnetic single component development as described in 1 above, wherein the divalent or higher polyvalent alcohol is a divalent or higher polyvalent aliphatic alcohol.

7. The toner for non-magnetic single component development as described in 1, 2, 3, 4, 5 or 6 above, wherein the polyester resin has a ratio (Mw/Mn) of the weight average molecular weight (Mw) to number average molecular weight (Mn) as measured by gel permeation chromatography (GPC) of 10 or more, and/or a ratio ($I_{10}/I_{01}$) of the relative intensity ($I_{10}$) at a position corresponding to the molecular weight of polystyrene of 100,000 to the relative intensity ($I_{01}$) at a position corresponding to the molecular weight of polystyrene of 10,000 as measured by GPC of 0.1 to 0.7.

8. The toner for non-magnetic single component development as described in 1, 2, 3, 4, 5 or 6 above, wherein the polyester resin has a ratio (Mw/Mn) of the weight average molecular weight (Mw) to number average molecular weight (Mn) as measured by gel permeation chromatography (GPC) of 15 to 60, and/or a ratio ($I_{10}/I_{01}$) of the relative intensity ($I_{10}$) at a position corresponding to the molecular weight of polystyrene of 100,000 to the relative intensity ($I_{01}$) at a position corresponding to the molecular weight of polystyrene of 10,000 as measured by GPC of 0.1 to 0.7.

9. The toner for non-magnetic single component development as described in 1, 2, 3, 4, 5 or 6 above, wherein the polyester resin has a ratio (Mw/Mn) of the weight average molecular weight (Mw) to number average molecular weight (Mn) as measured by gel permeation chromatography (GPC) of 10 or more, and/or a ratio ($I_{10}/I_{01}$) of the relative intensity ($I_{10}$) at a position corresponding to the molecular weight of polystyrene of 100,000 to the relative intensity ($I_{01}$) at a position corresponding to the molecular weight of polystyrene of 10,000 as measured by GPC of 0.1 to 0.7, and further a ratio ($I_{100}/I_{01}$) of the relative intensity ($I_{100}$) at a position corresponding to the molecular weight of polystyrene of 1,000,000 to the relative intensity ($I_{01}$) at a position corresponding to the molecular weight of polystyrene of 10,000 as measured by GPC of 0.01 to 0.3.

10. The toner for non-magnetic single component development as described in 1, 2, 3, 4, 5 or 6 above, wherein the non-magnetic single component developing is one which comprises triboelectrifying a toner transported by a toner carrier with a layer thickness controlling member and at the same time controlling the thickness of the layer to make a thin layer of toner on the toner carrier so that the toner can face a carrier for a static charge latent image in contact or not in contact with it to effect development of the static charge latent image.

11. The toner for non-magnetic single component development as described in 1, 2, 3, 4, 5 or 6 above, further comprising 5 to 30% by weight of a linear polyester resin.

EXAMPLES

Hereafter, the present invention will be described in further detail by examples and comparative examples. In the following description, the values in the table of formulation are each indicated as "parts by weight." First, synthesis examples for the binder resin used for preparing a toner are described.

Resin Production Example 1

Preparation of Resin Used

Five hundred and twenty seven (527) parts of polyoxypropylene (2.2)-2,2-bis(4-hydroxyphenyl)propane, 53 parts of Epiclon N-695 (polyfunctional cresol novolak type epoxy resin having more than two epoxy groups in the molecule), 20 parts of trimellitic anhydride, and 2.5 parts of tetrabutyl titanate are charged into a 2-L glass made four-necked flask equipped with a thermometer, a stirrer, and a nitrogen introduction pipe, and in an electric heat mantle, stirring was continued in a nitrogen flow at 240° C. at normal pressure for 15 hours to allow reaction and then the pressure was reduced gradually to 10 mmHg, at which pressure the reaction was continued. The reaction was traced by the softening point according to ASTM E28-517, and the reaction was terminated when the softening point reached 132° C.

Epiclon N-695 has a distribution in the number of epoxy groups in the molecule and is a polyfunctional cresol novolak type epoxy resin having a number of epoxy groups in the molecule of 2 or more with its average being 5 or more.

The obtained polymer is a colorless solid having an acid value of 4 KOHmg/g, a glass transition temperature of 63° C. as measured by a DSC measurement method, and softening point of 138° C.

Binder resins having formulations shown in Table 1 were produced by the method similar to that in Resin Production Example 1. Only in Resin Production Example 5, a fractionating column was additionally used. In Table 1, the unit for the softening point is degree centigrade, and Tg is a glass transition temperature as measured by a DSC measurement method.

TABLE 1

| Production Example | Epoxy compound | Alcohol component | Acid component | Softening point (° C.) |
|---|---|---|---|---|
| 1 | Epiclon N-695<br>53 | BPA(2,2)PO<br>527 | TPA<br>283<br>TMA<br>20 | 138 |
| 2 | Epiclon E-850<br>70 | BPA(2,2)PO<br>527 | TPA<br>283<br>TMA<br>30 | 133 |
| 3 | Epiclon N-775<br>48 | BPA(2,2)PO<br>527 | TPA<br>283<br>TMA<br>20 | 136 |
| 4 | Epiclon N-695<br>75 | BPA(2,2)PO<br>527 | TPA<br>301 | 136 |
| 5 | Epiclon N-695<br>7 | DEG<br>21<br>NPG<br>104<br>EG<br>50 | TPA<br>315 | 140 |

| Production Example | Tg° C. | Mw | Mn | Mw/Mn | $I_{10}/I_{01}$ | $I_{100}/I_{01}$ |
|---|---|---|---|---|---|---|
| 1 | 63 | 132000 | 4900 | 26.9 | 0.25 | 0.18 |
| 2 | 59 | 185900 | 3100 | 59.0 | 0.55 | 0.15 |
| 3 | 62 | 253000 | 5100 | 49.6 | 0.35 | 0.10 |
| 4 | 64 | 181000 | 4950 | 36.6 | 0.27 | 0.25 |
| 5 | 62 | 96000 | 4800 | 20 | 0.15 | 0.28 |

The softening point of the resin in Production Example 5 was 140° C.

In Table 1, abbreviations are as follows.

BPA(2.2)PO: Bisphenol A 2.2 mol propylene oxide adduct

TPA: terephthalic acid

TMA: Trimellitic anhydride

Epiclon N-695: Polyfunctional cresol novolak type epoxy resin (epoxy equivalent: 220) manufactured by Dainippon Ink and Chemicals, Inc.

Epiclon E-850: Polyfunctional Bisphenol A type epoxy resin (epoxy equivalent: 190) manufactured by Dainippon Ink and Chemicals, Inc.

Epiclon N-775: Polyfunctional phenol novolak type epoxy resin (epoxy equivalent: 190) manufactured by Dainippon Ink and Chemicals, Inc.

DEG: Diethylene glycol

NPG: Neopentyl glycol

EG: Ethylene glycol

FIG. 1 is a diagrammatic graph showing GPC data measured with regard to a binder resin produced by Resin production Example 2.

In the graph,

"A" indicates the relative intensity at a position corresponding to the molecular weight of 10,000, "B" indicates the relative intensity at a position corresponding to the molecular weight of 100,000, and "C" indicates the relative intensity at a position corresponding to the molecular weight of 1,000,000.

Example 1

| | Part by weight |
|---|---|
| Resin of Resin Production Example 1 | 92 |
| Carbon black | 5 |
| Mogul L (manufacture by Cabbott Specialty Chemicals, Inc.) | |
| Charge control agent | 1 |
| Charge control agent of Chemical Formula 2 | |
| Wax | 2 |
| Viscol 550P (manufactured by Sanyo Kasei Kogyo Co., Ltd.) | |

The above ingredients were mixed in a Henschel mixer and kneaded using a twin-screw kneader. The thus-obtained kneaded product was pulverized and graded to obtain a toner powder A.

| | |
|---|---|
| Toner powder | 100 parts by weight |
| Silica NAX50 | 1 part by weight |
| Silica R972 | 2 parts by weight |

were mixed in a Henschel mixer and sifted to obtain a toner A.

Example 2

Toner B was obtained in the same manner as in Example 1 except that the resin of Resin Production Example 2 was used instead of the resin of Resin Production Example 1.

Example 3

Toner C was obtained in the same manner as in Example 1 except that the resin of Resin Production Example 3 was used instead of the resin of Resin Production Example 1.

Example 4

Toner D was obtained in the same manner as in Example 1 except that there were used:

Charge control agent of Chemical Formula 1 (counter cation: $H^+$): 0.6 parts by weight Charge control agent of Chemical Formula 2: 0.6 parts by weight as the charge control agent.

Example 5

Toner E was obtained in the same manner as in Example 4 except that in Example 4, 94 parts of the resin of Resin Production Example 1 and 3 parts of copper phthalocyanine "KET BLUE 111 (manufactured by Dainippon Ink and Chemicals, Inc.) as a colorant were used.

Example 6

Toner F was obtained in the same manner as in Example 1 except that the resin of Resin Production Example 5 instead of the resin of Resin Production Example 1 was used as a binder resin and there were used:

Charge control agent of Chemical Formula 1 (counter cation: $H^+$): 0.6 parts by weight Charge control agent of Chemical Formula 2: 0.6 parts by weight as the charge control agent. This toner had a volume average particle diameter of 10.1 $\mu$m.

Example 7

Toner G was obtained in the same manner as in Example 1 except that the resin of Resin Production Example 5 instead of the resin of Resin Production Example 1 was used as a binder resin, 3 parts of copper phthalocyanine "KET BLUE 111 (manufactured by Dainippon Ink and Chemicals, Inc.) was used as a colorant, and there were used:

Charge control agent of Chemical Formula 1 (counter cation: $H^+$): 0.6 parts by weight Charge control agent of Chemical Formula 2: 0.6 parts by weight as the charge control agent. This toner had a volume average particle diameter of 10.1 $\mu$m.

Comparative Example 1

A comparative resin was synthesized in the same manner as in Resin Production Example 1 except the epoxy compound N-695 was not used, and 45 g of TMA was used. This was named Comparative Resin 1.

The polymer obtained was a colorless solid and had an acid value of 5 KOH/mg, a glass transition temperature of 61° C. as measured by a DSC measurement method, a softening point of 137° C., an Mw of 158,000, an Mn of 4,800, Mw/Mn=32.9, $I_{10}/I_{01}$=0.25, and $I_{100}/I_{01}$=0.01.

Comparative Toner-1 was obtained by producing a toner in the same manner as in Example 1 except that in Example 1, Comparative Resin 1 was used instead of the resin of Resin Production Example 1.

The toners obtained in the above Examples and Comparative Example were evaluated for fixing-start temperature (=minimum fix temperature), offset resistance (measured by hot offset temperature), and development durability. The results of the evaluation are shown in Table 2.

Fixing-start temperature and offset resistance were measured under the following heat roll fixing machine conditions. The heat roll (upper) was made of TEFLON, and the lower roll was made of HTV silicone. Fixing tests were conducted at a load of 7 kg/350 mm, a nip width of 4 mm, and a paper feed speed of 280 mm/sec.

The roll diameter was 50 mm for each of the upper and lower rolls and a non-fixed image sample of each toner in an A4 paper size was used for the test.

The intensity of fixation was judged by image density residual ratio as calculated by the following equation. The image density was measured using a Macbeth image densitometer RD-918.

Image density residual ratio=image density after fastness test/image density before fastness test Here, the image density after fastness test was measured using Gakushin type friction fastness tester (load: 200 g, friction operation: 5 strokes).

As the fixing intensity, a residual ratio of 80% or more is rated as a level which has no practical problem and the lowest temperature was defined as a fixing-start temperature.

The development durability was evaluated by performing continuous printing for 10 hours using a cartridge of a commercially available printer, from which cartridge the toner for exclusive use had been removed, and in which the toner of each of the Examples and the Comparative Example had been filled after washing the cartridge. The development durability is rated ○ if the toner layer on the development sleeve is uniform and no defect occurs and×when an uneven portion such as striation or the like occurs.

The fogging (=background) of the printed image was evaluated by measuring the density in the white portion of the printed matter using a Macbeth 918 RD densitometer (aperture diameter: 5 mmϕ) and then the density of unused white paper was measured in the same manner and the difference in density was indicated.

The above measurement items are shown in Table 2.

TABLE 2

| Example | Fixing-start temperature (° C.) | Offset generation temperature (° C.) | Development durability | Fogging |
|---|---|---|---|---|
| 1 | 130 | 250 | ○ | 0.009 |
| 2 | 130 | 250 | ○ | 0.008 |
| 3 | 130 | 250 | ○ | 0.008 |
| 4 | 130 | 245 | ○ | 0.001 |
| 5 | 130 | 250 | ○ | 0.001 |
| 6 | 115 | 260 | ○ | 0.001 |
| 7 | 115 | 260 | ○ | 0.001 |
| Comparative Example 1 | 140 | 215 | X | 0.009 |

What is claimed is:

1. A toner for non-magnetic single component development, comprising at least a binder resin, a colorant, and a charge control agent, said binder resin comprises a polyester resin obtained by reacting (1) a divalent or higher epoxy component, (2) a dibasic or higher polybasic acid compound selected from a polybasic acid and/or acid anhydride and/or lower alkyl ester thereof, and (3) a divalent or higher polyvalent alcohol, and said polyester resin is obtained by the reaction of (1), (2), (3) in the presence of a catalyst by a reaction selected from the group consisting of dehydrocondensation reaction and ester exchange, to produce a polyester resin having a high crosslinking density.

2. The toner for non-magnetic single component development as claimed in claim 1, wherein the polybasic acid compound is a non-addition polymerizable polybasic acid compound.

3. The toner for non-magnetic single component development as claimed in claim 1, wherein the polyester resin has a glass transition temperature of 55 to 85° C. and a softening point of 90 to 180° C.

4. The toner for non-magnetic single component development as claimed in claim 1, wherein the charge control agent is a negative charge control agent.

5. The toner for non-magnetic single component development as claimed in claim 1, wherein the divalent or higher polyvalent alcohol comprises polyoxypropylene-bis(4-hydroxyphenyl)propane.

6. The toner for non-magnetic single component development as claimed in claim 1, wherein the divalent or higher polyvalent alcohol is a divalent or higher polyvalent aliphatic alcohol.

7. The toner for non-magnetic single component development as claimed in claim 1, 2, 3, 4, 5 or 6, wherein the polyester resin has a ratio (Mw/Mn) of the weight average molecular weight (Mw) to number average molecular weight (Mn) as measured by gel permeation chromatography (GPC) of 10 or more, and/or a ratio ($I_{10}/I_{01}$) of the relative intensity ($I_{10}$) at a position corresponding to the molecular weight of polystyrene of 100,000 to the relative intensity ($I_{01}$) at a position corresponding to the molecular weight of polystyrene of 10,000 as measured by GPC of 0.1 to 0.7.

8. The toner for non-magnetic single component development as claimed in claim 1, 2, 3, 4, 5 or 6, wherein the polyester resin has a ratio (Mw/Mn) of the weight average molecular weight (Mw) to number average molecular weight (Mn) as measured by gel permeation chromatography (GPC) of 15 to 60, and/or a ratio ($I_{10}/I_{01}$) of the relative intensity ($I_{01}$) at a position corresponding to the molecular weight of polystyrene of 100,000 to the relative intensity ($I_{10}$) at a position corresponding to the molecular weight of polystyrene of 10,000 as measured by GPC of 0.1 to 0.7.

9. The toner for non-magnetic single component development as claimed in claim 1, 2, 3, 4, 5 or 6, wherein the polyester resin has a ratio (Mw/Mn) of the weight average molecular weight (Mw) to number average molecular weight (Mn) as measured by gel permeation chromatography (GPC) of 10 or more, and/or a ratio ($I_{10}/I_{01}$) of the relative intensity ($I_{01}$) at a position corresponding to the molecular weight of polystyrene of 100,000 to the relative intensity ($I_{10}$) at a position corresponding to the molecular weight of polystyrene of 10,000 as measured by GPC of 0.1 to 0.7 and further a ratio ($I_{100}/I_{01}$) of the relative intensity ($I_{100}$) at a position corresponding to the molecular weight of polystyrene of 1,000,000 to the relative intensity ($I_{10}$) at a position corresponding to the molecular weight of polystyrene of 10,000 as measured by GPC of 0.01 to 0.3.

10. The toner for non-magnetic single component development as claimed in claim 1, 2, 3, 4, 5 or 6, wherein the non-magnetic single component developing is one which comprises triboelectrifying a toner transported by a toner carrier with a layer thickness controlling member and at the same time controlling the thickness of a layer to make a thin layer of toner on the toner carrier so that the toner can face a carrier for a static charge latent image in contact or not in contact with it to effect development of the static charge latent image.

11. The toner for non-magnetic single component development as claimed in claim 1, 2, 3, 4, 5 or 6, further comprising 5 to 30% by weight of a linear polyester resin.

* * * * *